US005173632A

United States Patent [19]

Dolan et al.

[11] Patent Number: 5,173,632

[45] Date of Patent: Dec. 22, 1992

[54] HIGH PRESSURE SODIUM ARC DISCHARGE LAMP WITH WELDLESS ARC TUBE SUPPORT MEMBER

[75] Inventors: Robert B. Dolan, Manchester; Paul A. Young, Weare; Edward P. Otto, Henniker, all of N.H.

[73] Assignee: GTE Products Corporation, Danvers, Mass.

[21] Appl. No.: 661,038

[22] Filed: Feb. 26, 1991

[51] Int. Cl.[5] ..... H01J 61/34; H01J 61/30

[52] U.S. Cl. ..... 313/25; 313/1; 313/634

[58] Field of Search ..... 313/1, 25, 634

[56] References Cited

U.S. PATENT DOCUMENTS

| | | | |
|---|---|---|---|
| 2,197,220 | 4/1940 | Kost . | |
| 2,321,158 | 6/1943 | Rees . | |
| 2,951,959 | 9/1960 | Fraser et al. . | |
| 3,094,640 | 6/1963 | Gustin . | |
| 3,326,509 | 6/1967 | Kuttler . | |
| 3.882,346 | 5/1973 | McVey . | |
| 4,287,454 | 9/1981 | Feuersanger et al. . | |
| 4,689,518 | 8/1987 | King | 313/25 X |
| 4,924,133 | 5/1990 | Dassler et al. | 313/25 |
| 5,055,735 | 10/1991 | De Jong et al. | 313/634 |

FOREIGN PATENT DOCUMENTS 2303189 2/1976 France .

*Primary Examiner*—Sandra L. O'Shea

*Attorney, Agent, or Firm*—Joseph S. Romanow

[57] ABSTRACT

A high-pressure sodium arc discharge lamp having a novel arc tube support member which provides a secure mechanical and electrical connection and does not require welding between the support member and the arc tube lead wire or feedthrough. The support member may be adapted for mounting a single arc tube or two arc tubes within the outer envelope. The feedthrough of each arc tube is inserted into an aperture in the support member such that a secure interference fit is achieved. The interference fit is similar to the fastening of a threadless nut. In a preferred embodiment, the support member has a first planar surface having one or more apertures therein and two second planar surfaces substantially perpendicular to the first planar surface; each second planar surface has a protruding leg by which the support member may be mounted on the internal lamp frame. Several alternative designs are disclosed wherein, for example, the aperture may be circular or rectangular, the aperture may or may not have opposing tabs, and the cross section of the arc tube lead wire or feedthrough disposed within the aperture may be circular or rectangular.

15 Claims, 3 Drawing Sheets

HIGH PRESSURE SODIUM ARC DISCHARGE LAMP WITH WELDLESS ARC TUBE SUPPORT MEMBER

TECHNICAL FIELD

The present invention relates to a high-pressure sodium arc discharge lamp having an arc tube support member which provides a secure mechanical and electrical connection between the support member and the arc tube lead wire or feedthrough without a weld. A support member in accordance with the invention may be employed in lamps having one or two arc tubes within an outer envelope.

BACKGROUND ART

A typical high-pressure sodium arc discharge lamp has an arc tube mounted within a light-transmissive outer envelope. The mounting of the arc tube may include one or more welds for mechanical and electrical integrity. While this type construction is effective, it is expensive because the welding process, particularly where multiple welding operations are required, is difficult to automate. See U.S. Pat. No. 2,951,959, issued Sep. 6, 1960, to Fraser et al., applying broadly to any type of electric discharge device involving a double-enveloped construction.

As explained in U.S. Pat. No. 3,094,640, issued Jun. 18, 1963, to Gustin, relating to the construction of high-pressure electric discharge lamps, each spot weld affords an opportunity for imperfection in lamp construction and, consequently, it may be desirable to reduce the number of such welds where a feasible alternative construction technique is available.

U.S. Pat. No. 4,287,454, issued Sep. 1, 1981, to Feuersanger et al., illustrates a high-pressure sodium lamp with two arc tubes mounted by a construction which may include multiple spot welds. The number of welds required for mounting two arc tubes in a lamp typically is double or higher than that required in a single arc tube counterpart. There is also the requirement for precision alignment of the two arc tubes, usually in a parallel arrangement. See U.S. Pat. No. 4,689,518, issued Aug. 25, 1987, to King.

It would be an advancement of the art if a support for mounting one or more arc tubes within the outer envelope of a high-pressure sodium lamp were available where the support is weldless and well adapted to automated construction techniques.

DISCLOSURE OF THE INVENTION

It is, therefore, an object of the invention to obviate the deficiencies in the prior art.

Another object of the invention is to provide a high-pressure sodium arc discharge lamp with a arc tube support member wherein the mounting of the arc tube on the support member may be accomplished without welding.

Yet another object of the invention is to provide a high-pressure sodium arc discharge lamp with a weldless arc tube support member wherein the mounting of the arc tube on the support member is relatively well suited to automated construction techniques.

Still another object of the invention is to provide a high-pressure sodium arc discharge lamp having two arc tubes within the outer envelope with a support member for both arc tubes, wherein the mounting of both arc tubes on the support member may be accomplished without welding and the weldless mounting process is relatively well suited to automated construction techniques.

These objects are accomplished, in one aspect of the invention, by provision of a high-pressure sodium arc discharge lamp comprising a base and a light-transmissive outer envelope hermetically enclosing an interior. The outer envelope has the base mounted on it. There are first and second electrical lead-in conductors extending into the interior. At least one arc tube is mounted within the interior. Each of the arc tubes has rigid first and second electrical lead wires. The lamp includes means for electrically coupling the first lead wire of each of the arc tubes with the first lead-in conductor.

The lamp also includes an arc tube support member for rigidly mounting the second lead wire of each of the arc tubes and for electrically coupling the second lead wire of each of the arc tubes with the second lead-in conductor. The arc tube support member includes at least one aperture formed therein, there being one aperture corresponding to each of the arc tubes. Each of the apertures is adapted to tightly receive the second lead wire of the corresponding arc tube such that there is a secure, weldless, mechanical, and electrical interference fit between the arc tube support member and the second lead wire of the corresponding arc tube.

BEST MODE FOR CARRYING OUT THE INVENTION

For a better understanding of the present invention, together with other and further objects, features, advantages, and capabilitities thereof, reference is made to the following disclosure and appended claims taken in conjunction with the above described drawings.

Figure 1:
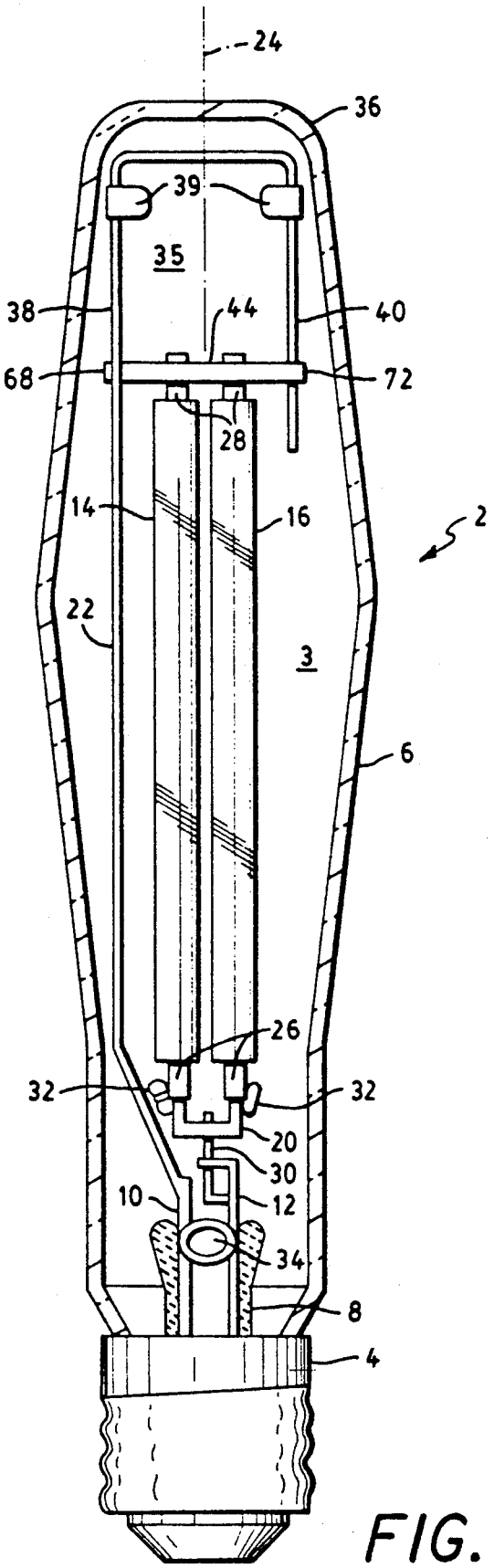
FIG. 1 is a partial cross-sectional elevational view of a high-pressure sodium arc discharge lamp having two arc tubes within the outer envelope in accordance with the present invention.
Figure 8:
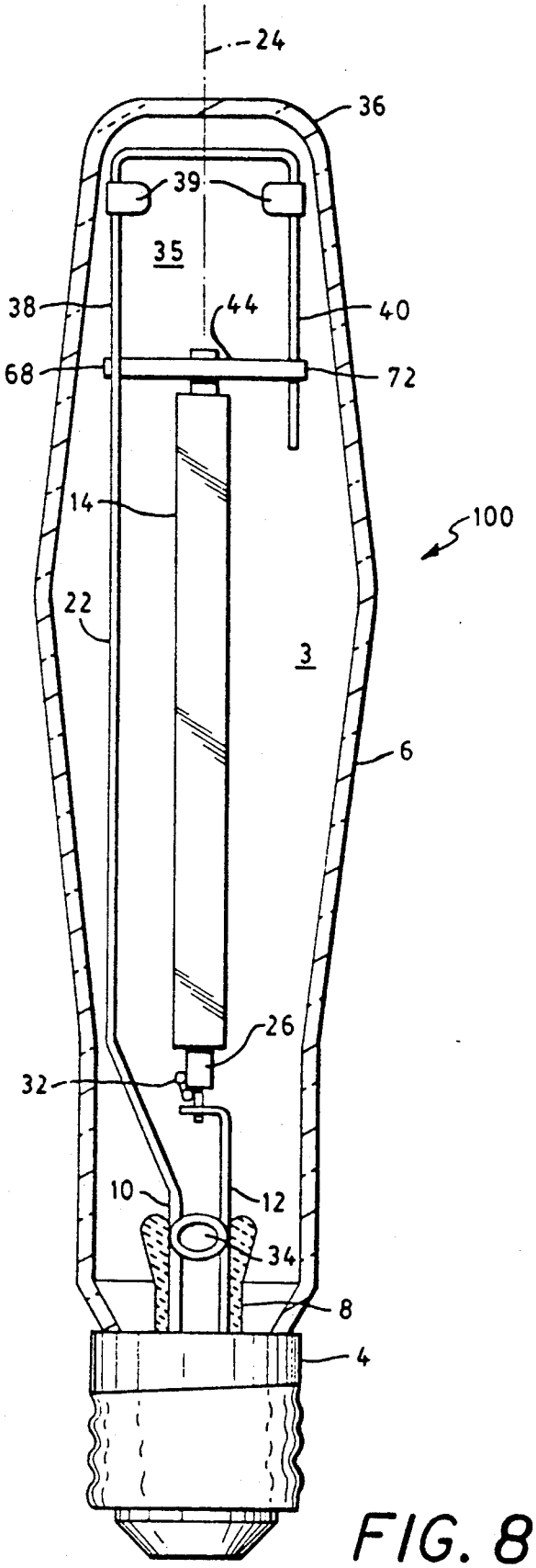
FIG. 8 is a partial cross-sectional elevational view of a high-pressure sodium arc discharge lamp having a single arc tube within the outer envelope in accordance with the present invention.

As may be seen from FIGS. 1 and 8, an arc tube support member in accordance with the invention is easily adapted for use in high-pressure sodium arc discharge lamps employing a single arc tube or two arc tubes. It is further within the scope of the invention to adapt the support member for mounting more than two arc tubes within the outer envelope of a lamp.

FIG. 1 depicts high-pressure sodium arc discharge lamp 2 having base 4 mounted on light-transmissive outer envelope 6. Base 4 is a known screw-type lamp base having two electrical poles. Outer envelope 6 hermetically encloses interior 3. In lamp 2, interior 3 is a vacuum. First electrical lead-in conductor 12 and second electrical lead-in conductor 10 extend through stem 8 in a conventional manner into interior 3 from respective electrical poles of base 4. In the lamp of FIG. 1, lead-in conductors 10 and 12 must be sufficiently rigid to provide support for other internal lamp parts. Outer envelope 6 of lamp 2 has dome 36, and internal dome region 35 in the vicinity of dome 36. Lead-in 10 extends into dome region 35 via frame segments 22, 38, and 40.

Lamp 2 includes two high-pressure sodium arc discharge tubes 14 and 16. Arc tubes 14 and 16 have a known fill material including an amalgam of sodium and mercury and an inert gas. Each arc tube is a typical cylindrical arc tube formed from a ceramic light-transmissive material, such as alumina or yttria, having electrodes sealed within both ends by known methods. As used herein, the term "lead wire" includes a feedthrough and further includes a solid wire, hollow tube, or a combination of a solid wire and hollow tube, such wire or tube typically, but not necessarily, having a circular cross section.

Each electrode may be mounted on an electrical feedthrough which is formed from a material, e.g., niobium, having a coefficient of thermal expansion reasonably close to that of the ceramic arc tube so that the arc tube seal may be maintained over the wide temperature range experienced during lamp start-up or cool-down. Each arc tube has a first rigid electrical lead wire 26 and a second rigid electrical lead wire 28 which provide electrical power to the arc tube. Lead wires 26 and 28 may be wires or hollow tubes. In lamp 2, lead wires 26 and 28 are hollow tubes formed from niobium in order to substantially match the coefficients of thermal expansion of the ceramic arc tubes and lead wires.

Lead wires 26 of both arc tubes are electrically coupled with lead-in conductor 12, and lead wires 28 of both arc tubes are electrically coupled with lead-in conductor 10 via arc tube support member 44 and frame segments 22, 38, and 40. Frame segments 38 and 40 are supported in dome region 35 by spring tabs 39 which are rigidly mounted on the frame segments and which press against the internal walls of outer envelope 6 in a known manner. Frame segment 22 is be mounted on and electrically coupled with lead-in conductor 10, e.g., by welding. Getter 34 (more than one may be employed) may be mounted on one of the lead-in conductors in a known manner.

In lamp 2, arc tubes 14 and 16 are supported near stem 8 by means of U-shaped support 20, which is mounted on lead-in conductor 12 by welding. Support 20 is made of an electrically conductive material and operates not only to support arc tubes 14 and 16 mechanically but also to provide electrical power from base 4 to the arc tubes. Arc tubes 14 and 16 are arranged parallel to each other and parallel to a lamp axis 24, as shown in the drawing.

Because of the high operating temperature of lamp 2, arc tubes 14 and 16 experience thermal expansion during lamp warm-up, particularly along the central axes of the arc tubes. This linear expansion is accommodated by the slip joint construction between lead wires 26 and support 20. Niobium lead wires 26 have hollow ends, each end being adapted to slidably receive one leg of U-shaped support 20. During lamp warm-up, the linear expansion of each arc tube causes the niobium lead wire to slide over a greater portion of the respective leg of U-shaped support 20. When the lamp is cold, there is sufficient space within the hollow end portions of each lead wire to permit full expansion of each arc tube. A flexible loop of niobium wire 32 is welded to lead wire 26 and one leg of support 20 for each arc tube in order to provide a reliable electrical connection over the slip joint. Each slip joint permits movement along the central axis of the respective arc tube and precludes any transverse movement so that the arc tubes remain parallel at all times. Each slip joint operates independently. In a typical double arc tube lamp, such as lamp 2, only one arc tube operates at any time and the operating arc tube will be hotter and will experience greater thermal expansion.

Arc tube support member 44 provides novel means for mechanically and electrically coupling arc tube lead wires 28 to frame segments 38 and 40. Support 44, in the embodiment of FIG. 1, includes a formed piece of refractory metal, steel, or stainless steel which has two apertures formed therein, one aperture for each arc tube lead wire 28, each aperture being adapted to tightly receive the corresponding lead wire in the form of a threadless nut configured to provide an interference fit with the lead wire. In the lamp embodiment of FIG. 1, each lead wire 28 is a niobium feedthrough. The threadless nut mounting of each lead wire on support 44 not only provides a reliable and lasting non-welded mechanical and electrical connection but also assures accurate and uniform spacing between the parallel arc tubes, fixed positioning of the arc tubes relative to the plane of the support frame, and improved ability of the internal lamp parts to withstand shock loads and vibration.

Figure 2:
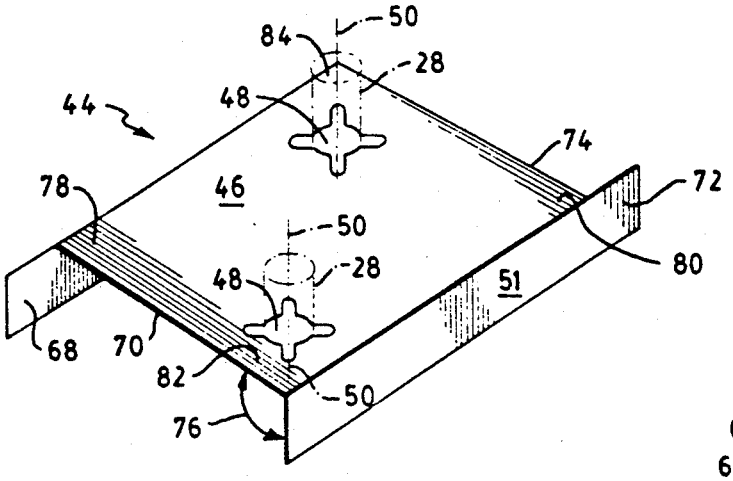
FIG. 2 is a perspective view of an arc tube support member employed in the embodiment of the invention shown in FIG. 1; the second lead wires or feedthroughs of the arc tube are shown in dashed lines in their mounted positions in the respective apertures of the support member.

Turning to FIG. 2 wherein a preferred embodiment of arc tube support member 44 is shown in greater detail. Support 44 includes planar surface 46 having two apertures 48 extending therethrough, one aperture for each lead wire 28. Each lead wire 28, shown in dashed lines in FIG. 2, extends through a respective aperture 48. Each aperture 48 is dimensioned for effecting an interference fit which prevents lateral and rotational movement between each lead wire 28 and support 44.

The type of interference fit employed in the present invention is similar in construction to that of a threadless nut. A typical threadless nut includes an aperture having opposing tabs adapted and dimensioned such that insertion of a rod into the aperture initially meets resistance. Upon applying a force in the direction of insertion, i.e., along the axis of the rod, the rod causes the opposing tabs of the aperture to spread apart sufficiently to permit forced insertion. The friction between the opposed tabs of the aperture and the lateral surface of the rod is sufficient to hold the rod tightly and securely in place. See, for example, U.S. Pat. No. 2,197,220, issued Apr. 16, 1940, to Kost; U.S. Pat. No. 2,321,158, issued Jun. 8, 1943, to Rees; U.S. Pat. No. 3,326,509, issued Jun. 20, 1967, to Kuttler; and French Patent No. 2,303,189.

Figure 3:
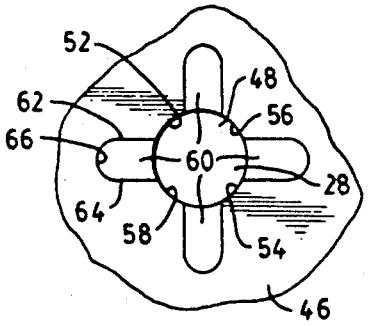
FIG. 3 is a plan view of a portion of an arc tube support member shown in FIG. 2; this embodiment shows a preferred embodiment of the aperture and tabs for the support member.

Arc tube support member 44 employs a similar interference fit between lead wires 28 and apertures 48. Each aperture 48 includes at least two opposing tabs facing a central axis 50 of each aperture 48. The distance between the opposing tabs is selected to effect a secure interference fit between lead wires 28 and apertures 48. As shown in FIG. 3, each aperture 48 has two pairs of opposing tabs: a first pair formed by tabs 52 and 54; and a second pair formed by tabs 56 and 58. There are spaces 60 between adjacent tabs, and each space 60 is equal in shape and dimensions to all other spaces 60. Each space 60 is formed by opposing parallel segments 62 and 64 and radiused segment 66. For purposes herein, aperture 48 as depicted in FIG. 3 is called a "Maltese cross." An advantage of the Maltese cross is that there is reduced heat conduction from the arc tube to the support member due to the reduced contact area in the aperture between the lead wire and tabs (because of the spaces between adjacent tabs).

As shown in FIG. 2, support member 44 further includes two planar surfaces 51, each surface 51 being substantially perpendicular to planar surface 46. Each surface 51 has a leg protruding therefrom; see legs 68 and 72 in the drawing. Leg 68 is mounted on frame segment 38 and leg 72 is mounted on frame segment 40 by welding. This completes the mechanical and electrical construction of the internal lamp parts with support member 44 being disposed in the internal dome region of lamp 2, as shown in FIG. 1. Preferably, support 44 may be formed from a metal sheet in a conventional stamping and pressing operation. The metal sheet should be thick enough to provide sufficient rigidity and resiliency for the support member to function as described herein.

In the embodiment of FIGS. 2, planar surface 46 may be in the shape of a rectangle or parallelogram. Leg 68 extends from corner 78 and leg 72 extends from diagonally opposed corner 80. First aperture 48 is located in corner 82 and second aperture 48 is located in diagonally opposed corner 84. Thus, mounting legs 68 and 72 are diagonally opposed along a first diagonal and both apertures 48 are diagonally opposed along a second diagonal. While this is a preferred arrangement of features of support 44, there are other arrangements and embodiments within the scope of the present invention.

FIG. 2 illustrates each lead wire 28 (in dashed lines) extending through a respective aperture 48. After insertion of the lead wire, four relatively resilient tabs, 52, 54, 56, and 58, of each aperture bear tightly against the lateral surface of each lead wire 28. The distance between tabs 52 and 54 equals the distance between tab 56 and 58, and this distance is selected to be sufficiently less than the cross sectional diameter of circular lead wire 28 so as to insure the mechanical and electrical integrity of the interference fit. By so dimensioning each aperture, opposing tabs 52, 54, 56, and 58 will be forced out of planar surface 46 when the lead wire is inserted. (See FIG. 5*b* for an example of tabs protruding out of the planar surface.) The resiliency of the material from which support 44 is formed yields a secure interference fit similar to that of a threadless nut.

Figure 4:
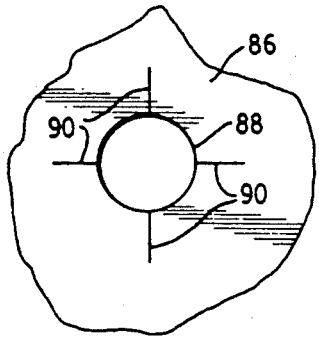
FIG. 4 is a plan view of a portion of an alternative arc tube support member in accordance with the present invention; this embodiment shows an alternate aperture and tabs for the support member.
Figure 5A:
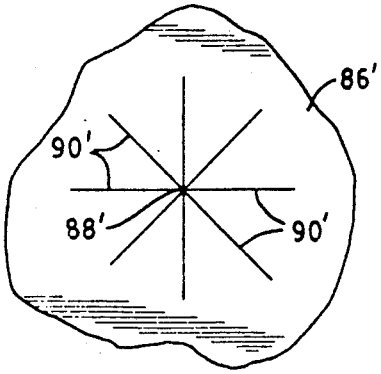
FIG. 5*a* is a plan view of a portion of yet another alternative arc tube support member in accordance with the present invention; this embodiment shows yet another alternate aperture and tabs for the support member.
Figure 5B:
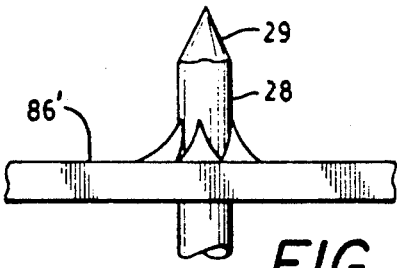
FIG. 5*b* is an elevational view of the embodiment of the arc tube support member of FIG. 5*a* with the second lead wire of an arc tube mounted therein.
Figure 6:
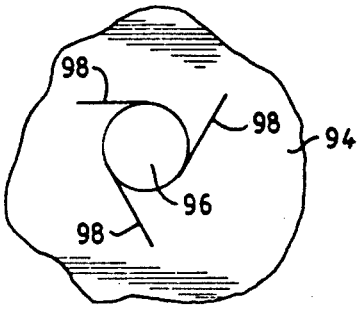
FIG. 6 is a plan view of a portion of still another alternative arc tube support member in accordance with the present invention; this embodiment shows still another alternate aperture and tabs for the support member.

FIGS. 4 to 6 show examples of alternate aperture configurations which provide an interference fit in accordance with the invention. FIG. 4 shows planar surface 86 having aperture 88 into which lead wire 28 may be inserted to effect an interference fit. A plurality of slits 90 extend radially from aperture 88. When the diameter of the lead wire is greater than the diameter of the aperture, the surface material between adjacent slits function as resilient tabs after insertion of the lead wire.

FIGS. 5*a* and 5*b* depict a variation of the embodiment of FIG. 4 wherein aperture 88' is pierced through planar surface 86' via radial slits 90'. It is understood that the term "aperture," as used throughout this specification, includes a hole with or without tabs as well as a configuration, like that of FIG. 5*a*, wherein the hole is created by the protruding tabs. FIG. 5*b* depicts aperture 88' with lead wire 28 inserted therein and the protruding tabs. Lead wire 28 may have conical tip 29 (not shown in FIG. 2) to facilitate insertion of the lead wire into aperture 88'.

In the embodiment of FIG. 6, planar surface 94 has aperture 96 extending therethrough. In this embodiment, a plurality of slits 98 extend through the planar surface, the slits 98 being tangential to the circumference of aperture 96.

It is within the scope of the invention for the aperture to be other than circular or substantially circular in shape. For example, the aperture may be shaped as a rectangle or parallelogram; such an aperture may include one or more pairs of opposing tabs; and such opposing tabs may shaped as a rectangle or parallelogram. The aperture may be some other shape, such as the Maltese cross of FIG. 3.

It is within the scope of the invention for the cross section of the lead wire within the aperture to be other than circular or substantially circular in shape. For example, the cross section of the lead wire within the aperture may be a rectangle or parallelogram.

It is within the scope of the invention for the shape of the aperture to be different from the shape of the cross section of the lead wire within the aperture. For example, a lead wire with a rectangular cross section may be inserted into a circular aperture or, conversely, a lead wire having a circular cross section may be inserted into a rectangular aperture.

Figure 7A:
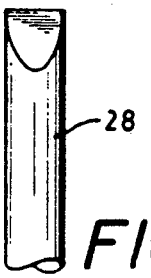
FIG. 7*a* is an elevational front view of an alternate embodiment of a second lead wire of an arc tube in accordance with the present invention.
Figure 7B:
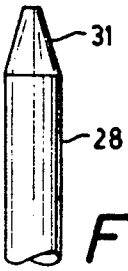
FIG. 7*b* is an elevational side view of the alternate embodiment of a second lead wire of an arc tube shown in FIG. 7*a*.

FIGS. 7*a* and 7*b* are an elevational and side view, respectively, of yet another alternate embodiment of lead wire 28, wherein lead wire 28 has a screw-driver-like tip, which may result from a pinch or compression seal of a hollow exhaust tube which serves as the electrical lead wire or feedthrough for the arc tube. The cross section of the portion of the lead wire that will be within the aperture is circular in these drawings; however, a rectangular cross section may also be employed. A pinch-seal-type tip, as illustrated in FIGS. 7*a* and 7*b*, is well suited for use with a Maltese cross aperture. To avoid damaging the hermetic seal, the Maltese cross configuration provides ample clearance for the pinch seal and engages the circular cross section effectively.

FIG. 8 shows lamp 100 which is an alternate embodiment of lamp 2 except that lamp 100 has a single arc tube 14 within outer envelope 6. The numbered identifiers of FIG. 8 have the same meaning as the corresponding identifiers of FIG. 1. In lamp 100, arc tube support member 44 has a single aperture in order to mount the single lead wire 28 in dome region 35. The single lead wire 26 near stem 8 is mounted by means of a single slip joint, as previously discussed, which is welded to lead-in conductor 12. In all other respects, lamp 100 is constructed and operates in the same manner as lamp 2.

WORKING EXAMPLES

Twin arc tube lamp examples were constructed and tested for several thousand hours in 70, 100, 150, 200, 250, and 400 watt designs. In all cases, lamp performance was good, electrically, photometrically, and mechanically. Single arc tube examples were constructed and tested for one hundred hours in a 400 watt design. These tests were discontinued after one hundred hours for destructive mechanical testing, i.e., shock and vibration tests. In all cases, lamp performance results were satisfactory.

In the laboratory examples, the arc tube support member has a rectangular shape with a Maltese cross aperture or apertures, substantially as shown in FIG. 2. The support member was formed from Type 316 stainless steel having various thicknesses of 0.005, 0.008, and 0.010 inches. Alternative materials for the support member, without limiting the scope of the invention, would be niobium, molybdenum, tungsten, kovar, steel, and alloys of these metals.

The arc tube lead wires were typical niobium tube feedthroughs. The lead-in conductors were formed from nickel wire having a 0.050 inch diameter. Alternative materials for the lead-in conductors, without limiting the scope of the invention, would be nickel plated steel, nickel iron, stainless steel, and alloys of these materials. The lamp frame members were formed from Type 316 stainless steel wire having a diameter of 0.070 inches. Alternative materials for the frame members, without limiting the scope of the invention, would be steel, nickel plated steel, and alloys of these materials.

In example lamps with two arc tubes, the U-shaped support was formed from nickel plated steel wire having a diameter of 0.060 inches. Alternate materials for the U-shaped support, without limiting the scope of the invention, would be stainless steel, nickel iron, and alloys of these materials. The electrical connector loop across the slip joints was niobium wire having a diameter of 0.040 inches. Any refractory metal, such as molybdenum, tantalum, tungsten, or nickel, would be an alternate material for the connector loop, although niobium is preferred. Other lamp components, e.g., sodium arc discharge tube(s), outer envelope, etc., were standard components.

While there have been shown what are at present considered to be the preferred embodiments of the invention, it will be apparent to those skilled in the art that various changes and modifications can be made herein without departing from the scope of the invention as defined in the appended claims.

We claim:

1. A high-pressure sodium arc discharge lamp comprising:

(a) a base;

(b) a light-transmissive outer envelope hermetically enclosing an interior, said outer envelope having said base mounted thereon;

(c) first and second electrical lead-in conductors extending into said interior;

(d) at least one arc tube mounted within said interior, each of said arc tubes having rigid first and second electrical lead wires;

(e) means for electrically coupling said first lead wire of each of said arc tubes with said first lead-in conductor; and (f) an arc tube support member for rigidly mounting said second lead wire of each of said arc tubes and for electrically coupling said second lead wire of each of said arc tubes with said second lead-in conductor, said arc tube support member including a planar surface with at least one aperture formed therein, there being one aperture corresponding to each of said arc tubes, each of said apertures being adapted to tightly receive said second lead wire of said corresponding arc tube such that there is a secure, weldless, mechanical, and electrical interference fit between said arc tube support member and said second lead wire of said corresponding arc tube.

2. A high-pressure sodium arc discharge lamp as described in claim 1 wherein said outer envelop has a dome opposed to said base, said interior includes a dome region in the vicinity of said dome, said second lead-in conductor extends into said dome region, and said arc tube support member is disposed in said dome region.

3. A high-pressure sodium arc discharge lamp as described in claim 1 wherein at least one of said apertures is circular.

4. A high-pressure sodium arc discharge lamp as described in claim 1 wherein the cross section of said lead wire of said corresponding arc tube is circular.

5. A high-pressure sodium arc discharge lamp as described in claim 1 wherein at least one of said apertures is shaped substantially as a parallelogram.

6. A high-pressure sodium arc discharge lamp as described in claim 1 wherein the cross section of said lead wire of said corresponding arc tube is shaped substantially as a parallelogram.

7. A high-pressure sodium arc discharge lamp as described in claim 1 wherein said arc tube support member includes two opposed resilient tabs within at least one of said apertures such that when said lead wire of said corresponding arc tube is mounted within said aperture said tabs press firmly against said lead wire to effectuate said interference fit.

8. A high-pressure sodium lamp as described in claim 7 wherein said arc tube support member includes a plurality of said pairs of opposed resilient tabs.

9. A high-pressure sodium arc discharge lamp as described in claim 7 wherein said support includes a planar surface through which said aperture passes and said resilient tabs protrude from said planar surface when said lead wire of said corresponding arc tube is mounted within said aperture.

10. A high-pressure sodium arc discharge lamp as described in claim 1 wherein said lamp includes a frame segment electrically coupled with said second lead-in conductor, said arc tube support member has a body and at least one leg protruding from said body and said leg is securely mounted on said frame segment.

11. A high-pressure sodium arc discharge lamp as described in claim 10 wherein said arc tube support member includes a first planar surface through which each of said apertures passes, a second planar surface substantially perpendicular to said first planar surface, and said leg protrudes from said second planar surface.

12. A high-pressure sodium arc discharge lamp as described in claim 1 wherein said lamp has two arc tubes mounted within said outer envelope and said arc tube support member has two apertures formed therein.

13. A high-pressure sodium arc discharge lamp as described in claim 8 wherein the interior boundary of said aperture and said resilient tabs is substantially in the shape of a Maltese Cross.

14. A high-pressure sodium arc discharge lamp as described in claim 1 wherein said arc tube support member is formed from a refractory metal.

15. A high-pressure sodium arc discharge lamp as described in claim 14 wherein said arc tube support member is formed from stainless steel.

* * * * *